US010683561B2

(12) United States Patent
Li et al.

(10) Patent No.: US 10,683,561 B2
(45) Date of Patent: Jun. 16, 2020

(54) METHOD FOR DIRECTLY PRODUCING PICKLING-FREE HOT-PLATED SHEET STRIP PRODUCT FROM MOLTEN STEEL

(71) Applicant: BAOSHAN IRON & STEEL CO.,LTD., Shanghai (CN)

(72) Inventors: Jun Li, Shanghai (CN); Ning Tan, Shanghai (CN); Chuang Guan, Shanghai (CN); Yuan Fang, Shanghai (CN); Xinjian Ma, Shanghai (CN)

(73) Assignee: Baoshan Iron & Steel Co., Ltd., Shanghai (CN)

( * ) Notice: Subject to any disclaimer, the term of this patent is extended or adjusted under 35 U.S.C. 154(b) by 255 days.

(21) Appl. No.: 15/314,934

(22) PCT Filed: Dec. 23, 2014

(86) PCT No.: PCT/CN2014/094611

§ 371 (c)(1),
(2) Date: Nov. 29, 2016

(87) PCT Pub. No.: WO2015/180462

PCT Pub. Date: Dec. 3, 2015

(65) Prior Publication Data

US 2017/0114427 A1 Apr. 27, 2017

(30) Foreign Application Priority Data

May 30, 2014 (CN) ..... 2014 1 0240632
May 30, 2014 (CN) ..... 2014 1 0240643

(51) Int. Cl.
*C21D 9/56* (2006.01)
*B22D 11/11* (2006.01)
(Continued)

(52) U.S. Cl.
CPC ..... *C21D 9/561* (2013.01); *B22D 11/06* (2013.01); *B22D 11/0622* (2013.01);
(Continued)

(58) Field of Classification Search
None
See application file for complete search history.

(56) References Cited

U.S. PATENT DOCUMENTS 6,622,778 B1 9/2003 Feldbauer
2008/0115906 A1* 5/2008 Peterson ..... B22D 11/001 164/57.1

FOREIGN PATENT DOCUMENTS

CN 103537640 1/2014
CN 103537640 A 1/2014
(Continued)

OTHER PUBLICATIONS

Machine-English translation of CN 103537640 A to Liu, Zhenyu et al., Jan. 29, 2014.*
(Continued)

*Primary Examiner* — Colleen P Dunn
*Assistant Examiner* — Jeremy C Jones
(74) *Attorney, Agent, or Firm* — Thomas Horstemeyer, LLP

(57) ABSTRACT

Method for directly producing a pickling-free hot-plated sheet strip product from molten steel comprising: obtaining a refined molten steel; thin strip continuous casting: a mixed gas of an inert gas and a reducing gas is used for protection in the billet casting process; hot rolling: the cast strip is levelled at a high temperature so as to improve the sheet shape and rolled to a suitable thickness so as to change the product specification, or provide a mechanical disruption action on the iron oxide skin on the surface of the cast strip; reduction annealing: a sectional reduction method is used to
(Continued)

perform sectional reductions with the temperature held within two ranges, i.e., 450-600° C. and 700-1000° C., wherein the reduction is performed within a range of 450-600° C. for 1-5 minutes and within a range of 700-1000° C. for 1-3 minutes to remove the iron oxide skin produced in the previous procedure, the concentration of the reducing gas being not lower than 5%; and hot galvanization: after having been cooled in a protective atmosphere, the strip billet is brought into a zinc bath and hot-plated with zinc and other alloy, and then cooled and coiled. The present invention realizes a highly continuous production of a hot-plated product from molten steel with iron and steel, and hot plating with zinc or an alloy is directly performed without removing elementary iron produced by the reduction, so that the energy consumption in the middle stage can be saved and the recovery of metal reaches close to 100%.

26 Claims, 8 Drawing Sheets

(51) Int. Cl.

| | |
|---|---|
| ***C21D 1/26*** | (2006.01) |
| ***C23C 2/40*** | (2006.01) |
| ***C21D 8/02*** | (2006.01) |
| ***C23C 2/06*** | (2006.01) |
| ***C23C 2/12*** | (2006.01) |
| ***B22D 11/06*** | (2006.01) |
| ***C21D 1/76*** | (2006.01) |
| ***C21D 9/52*** | (2006.01) |

(52) U.S. Cl.

CPC ..... *B22D 11/11* (2013.01); *C21D 1/26* (2013.01); *C21D 1/76* (2013.01); *C21D 8/0226* (2013.01); *C21D 8/0263* (2013.01); *C21D 8/0278* (2013.01); *C21D 9/52* (2013.01); *C23C 2/06* (2013.01); *C23C 2/12* (2013.01); *C23C 2/40* (2013.01)

(56) References Cited

FOREIGN PATENT DOCUMENTS

| | | | |
|---|---|---|---|
| CN | 103726003 A | * | 4/2014 |
| CN | 103726003 A | | 4/2014 |
| JP | H06145937 A | | 5/1994 |
| RU | 2011138408 | | 3/2013 |

OTHER PUBLICATIONS

English abstract of JP 2001-115247 A, Kurosaki, Masao et al., Apr. 24, 2001.*

Englsih abstract of JP405222571 A, Hotta, Takashi et al., Aug. 31, 1993.*

PCT/CN2014/094611 International Search Report and Written Opinion, dated Mar. 27, 2015.

Office Action dated Oct. 19, 2018 for Russian Application No. RU2016152000 with the English translation.

* cited by examiner

METHOD FOR DIRECTLY PRODUCING PICKLING-FREE HOT-PLATED SHEET STRIP PRODUCT FROM MOLTEN STEEL

CROSS-REFERENCE TO RELATED APPLICATIONS

This application is a United States National Stage Application of and claims the benefit pursuant to 35.U.S.C. § 371 of International Application No. PCT/CN2014/094611, which was filed on Dec. 23, 2014. PCT/CN2014/094611 claims benefit and priority to Chinese patent Application 201410240643.3, which was filed on May 30, 2014. PCT/CN2014/094611 also claims benefit and priority to Chinese patent Application 201410240632.5, which was filed on May 30, 2014. Each of the above-referenced applications are hereby incorporated by reference herein in their entirety.

TECHNICAL FIELD

The present invention relates to a method for the continuous production of a hot-plated product, and particularly relates to a method for directly producing a pickling-free hot-plated sheet strip product from molten steel.

BACKGROUND ART

With the continuous aggravation of the resource and energy crisis, topics such as being environmentally friendly, sustainable development, green economy, low carbon economy gets increasing attention, and the national "12th five-year" plan also clearly states that energy conservation and emission reduction will be taken as an important task, which raises a severe test for the iron and steel industry with respect to the traditional industries.

In the mid-nineteenth century, British Henry Bessemer first proposed a method for casting a metal thin strip using a twin-roll continuous caster, i.e., a technique for directly casting molten steel as a thin strip billet so that the intermediate billet casting and hot rolling procedures are saved. With the continuous improvement of techniques, the envisage of Bessemer is widely developed in the recent 30 years, iron and steel enterprises all over the world establish thin strip continuous casting experimental units one after another, and among them, some also realized industrial productions; and such a technique for directly casting molten steel as a thin strip billet is mainly used for the manufacture of stainless steels, high-speed steels and nonferrous metals. Among various thin strip continuous casting techniques, a horizontal isodiametric twin-roll thin strip continuous casting technique is the most maturely developed technique, and the method can produce a thin strip billet having a final thickness of 2-6 mm.

As compared to traditional sheet production process routes, the thin strip continuous casting technique has characteristics, such as a short flow, a small investment of capital construction, achieving "once heating production", etc., which substantially improves the energy efficiency of steel production and saves the production cost. However, the surface quality of a product from the thin strip continuous casting is not high, and subsequent processing is required in general.

The process for hot galvanization, including hot plating with pure zinc and other alloy, is an important method for enabling steel and iron materials to be oxidation resistant and prevention from atmospheric corrosion, and hot-galvanized products have characteristics, such as a remarkable protection effect, a good surface quality, low costs, etc., and are widely used in industries such as automobiles, ships, constructions. Hot-galvanized products on the current market are mostly produced by continuous hot-galvanization production lines, and such processes have a long production cycle, wherein a metal needs to experience a plurality of procedures such as billet casting, hot rolling, pickling, cold rolling, etc., from molten steel to continuous annealing and hot-galvanization; it is these complex processing procedures that cause a difficulty of matching thin strip continuous casting with the hot-galvanization process, wherein the key obstacle comes from the pickling procedure, and the pickling procedure can further results in a serious pollution and damage to the environment.

Chinese patent application no. 201310489332.6 discloses a method for producing a hot-rolled pickling-free sheet by combining thin strip continuous casting with reduction annealing, and the general process route is: cast-rolling molten steel into a strip billet, hot levelling, then cooling and coiling, wherein in order to obtain the pickling-free product, it is necessary to uncoil a cast-rolled sheet coil, perform reduction annealing, and then coiling the finished product or perform hot galvanization, and the resulting hot-galvanized product is still obtained from separated lines with a plurality of procedures and lacking continuity. American U.S. Pat. No. 6,588,491 B2 discloses a method for directly producing a pickling-free strip steel, wherein the critical step is casting molten steel as a thin strip, reduction annealing (reducing iron oxide skin into a porous iron), and mechanically brushing away the porous iron so as to obtain a pickling-free strip steel; with this as a core, and by adding procedures such as hot rolling, cold rolling, oil coating, hot galvanization, electro galvanization etc. before and after this step, the production of various products is achieved. The defect is that the metal iron produced by the reduction is mechanically brushed away, which only increases the production procedure, but also reduces the metal recovery, thus increasing the production cost; in addition, the reduction is reduction at a certain holding temperature and then cooling, as shown in FIG. 1, i.e., a one-section temperature holding reduction procedure is used, and the main difficulties faced are all as follows: the iron oxide skin reduction rate is low, the efficiency is low, the reduction is not complete, and the product performance is affected; and reference can be made to FIGS. 2-5, wherein the reduction of the iron oxide skin in FIG. 2 is not complete, the iron oxide close to the surface is reduced, while a great amount of oxides are remained at the underlayer; FIG. 3 is large cracks present on the surface after the reduction of the hot-rolled sheet; moreover, the reduction efficiency is low, and a great amount of oxides on the surface are not reduced in time; the reduction of the iron oxide skin in FIG. 4 is not complete, the periphery of oxide particles is reduced, while the centre is still oxides; and the reduced iron in FIG. 5 is uniformly distributed on the surface, but has a dense structure and on the contrary blocks the transfer of the reducing gas, affecting the reduction of the oxides in the internal layer, and finally leading to a non-thorough reduction.

Therefore, there is an urgent need to provide a new method capable of achieving directly producing a pickling-free hot-galvanized sheet strip product from molten steel by a rational design and optimization, so as to enable a shorter flow, a higher reduction efficiency and a higher metal recovery.

DISCLOSURE OF THE INVENTION

An object of the present invention is providing a method for directly producing a pickling-free hot-plated thin strip product from molten steel, wherein a pickling free technique can be used to combine thin strip continuous casting production with hot plating production, so that a highly continuous production of a hot-plated product from molten steel with iron and steel is realized, with reduced procedures and improved metal recovery.

In order to achieve the above-mentioned object, the method for directly producing a pickling-free hot-plated sheet strip product from molten steel provided by the present invention comprises the following steps:

smelting and refining to obtain a refined molten steel;

thin strip continuous casting: after having been adjusted via a steel ladle and a tundish, the refined molten steel is solidified as a strip billet under the cooling action of a twin-roll strip casting machine in a closed melting pool and protected using a mixed gas of an inert gas and a reducing gas in the billet casting process;

reduction annealing: the strip billet is brought into a reduction annealing furnace and reduced using a mixed gas of an inert gas and a reducing gas to remove the iron oxide skin produced in the previous procedure; and hot plating: after having been cooled in a protective atmosphere, the strip billet is brought into a zinc bath and hot-galvanized or hot-plated with other alloy, and then cooled and coiled.

After the thin strip continuous casting, the following step is further comprised: the strip billet is levelled at a high temperature so as to improve the sheet shape and rolled to a suitable thickness so as to change the product specification, or the iron oxide skin on the surface of the strip billet undergoes mechanical disruption, with the deformation rate being 1-30%.

said deformation rate is 5%, 10% or 20%.

4. The method for directly producing a pickling-free hot-plated thin strip product from molten steel according to claim 1, wherein the concentration of the reducing gas in the mixed gas during the thin strip continuous casting is 1-10%.

In the reduction annealing step, the reduction process comprises two heating and temperature holding sections, as shown in FIG. 2, performing sectional heating and temperature holding on the hot-rolled sheet within two ranges, i.e., 450-600° C. and 700-1000° C., so as to reduce the iron oxide skin on the surface of the hot-rolled sheet, wherein the reduction is performed within a range of 450-600° C. for 1-5 minutes and within a range of 700-1000° C. for 1-3 minutes, and the reducing gas is always maintained from the first heating section to an exit of a cooling section in said reduction furnace, wherein the concentration of the reducing gas in each section is the same or different, and the concentration of the reducing gas in the entire reduction furnace is 5-100%.

the concentration of said reducing gas is 5-30%.

the concentration of said reducing gas is 5%, 10% or 15%.

said inert gas is nitrogen or argon, and said reducing gas is hydrogen or carbon monoxide.

in the hot rolling step, a single stand is used and a blast device is provided for discontinuously or continuously introducing an inert gas into the hot rolling area to reduce the contact chance between the steel sheet and air so as to reduce the oxidization on the surface of the steel sheet.

In the reduction annealing step, said mixed gas flows in a turbulence way in the furnace, and the contents of water and hydrogen in the mixed gas are related to temperature, wherein at the same temperature, the lower the water content, i.e., the greater the hydrogen-water ratio, the higher the iron oxide reduction efficiency; and when the water content is too high, i.e., the hydrogen-water ratio is lower than a certain value, the reaction cannot occur, and at different temperatures, the minimum value of hydrogen-water ratio varies slightly, the minimum value of the hydrogen-water ratio being slightly smaller at a higher temperature.

At 500° C., the hydrogen-water ratio is minimally 4.1; and at 1000° C., the hydrogen-water ratio is minimally 0.9.

Before entering the reduction annealing furnace, the iron oxide skin on the surface of the strip billet is controlled at an average thickness of 1-5 μm.

In the hot plating step, when the hot galvanization is performed, it is the cooling needs to be to 450-460° C.; When the hot plating with aluminium-zinc is performed, the cooling needs to be to 590-610° C.; and when the hot plating with aluminium-silicon is performed, the cooling needs to be to 680-670° C.

In the hot plating step, the plating is Zn, Zn—Al, Zn—Al—Mg, Zn—Al—Mg—Si, or an Al—Si alloy.

After the hot plating step, alloying, oil coating, embossing, film coating or directly a forming procedure can be performed.

The method for directly producing a pickling-free hot-plated thin strip product from molten steel of the present invention is a process for directly changing molten steel into a hot-plated product using a twin-roll thin strip continuous casting technique combined with a pickling-free hot plating technique, mainly comprising: molten steel refining, thin strip billet continuous casting, hot rolling, reduction annealing, hot plating zinc and other alloy, cooling and coiling; and as compared to traditional hot-plated product production routes, the present invention has the following advantages:

1. Short Product Manufacturing Route

In the process, the hot-plated product is produced using molten steel directly, a plurality of traditional production lines of billet casting, hot rolling, pickling, cold rolling, continuous annealing and hot plating are integrated as one line, so as to substantially shorten the processing route, substantially increase the production efficiency, and greatly reduce the equipment investment.

2. Economic, Energy Saving and Environmentally Friendly

Since a great amount of intermediate processing, transportation, storage and management costs are saved, and the production efficiency is high, the product cost is greatly reduced; no surface dephosphorization is required for the hot-rolled sheet, which also omits the original steps such as cooling after hot rolling, coiling and uncoiling, mechanically brushing away elementary iron, with the metal recovery being close to 100%, and the properties of the resulting product being unchanged; the energy consumption in the middle chain is saved, so that the energy consumption for the product is greatly reduced; there is neither any polluting substance used in the production process, nor harmful waste gas and waste liquid discharged, which provides a prominent environmentally friendly advantage; and two heating and temperature holding sections, first at a low temperature and then at a high temperature, are used in the reduction step, so that different reduction characteristics at different temperatures are brought into full play, improving the reduction efficiency and effect.

Therefore, the present invention has a plurality of advantages such as a simple process, a low equipment investment, a low energy consumption, a high product yield, being environmentally friendly, etc.

Figure 7:
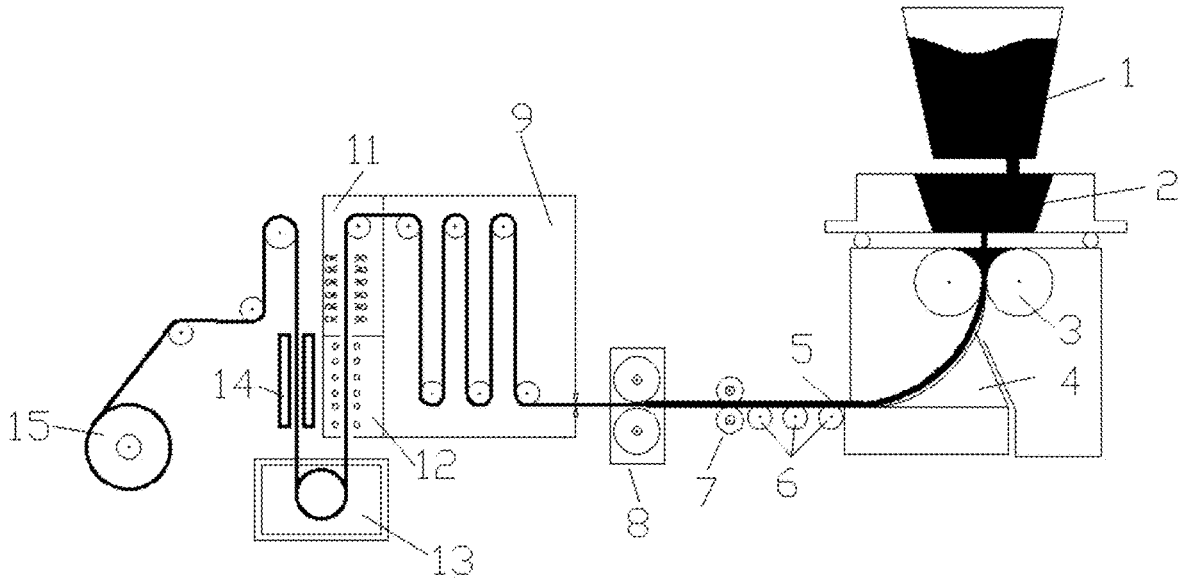
FIG. 7 is a schematic process route diagram of the method for directly producing a pickling-free hot-plated sheet strip product from molten steel in an embodiment of the present invention.

References in FIG. 7 are: steel ladle 1, tundish 2, twin-roll strip casting machine 3, exit strip support plate 4, thin strip billet 5, support roller 6, pinch roller 7, hot rolling machine 8, reduction annealing furnace 9, cooling section 11, temperature holding section before entering a zinc bath 12, zinc bath 13, after-plating cooling section 14, and coiling machine 15.

Figure 8:
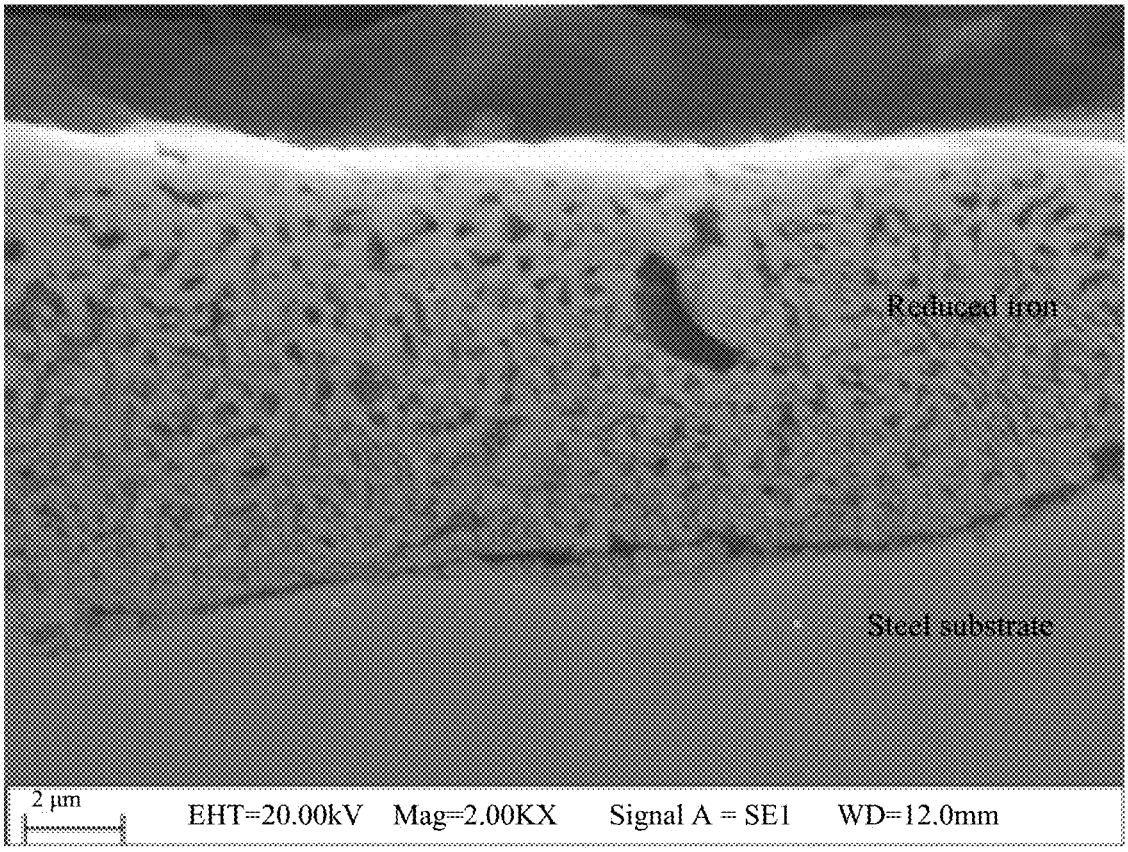
Figure 9:
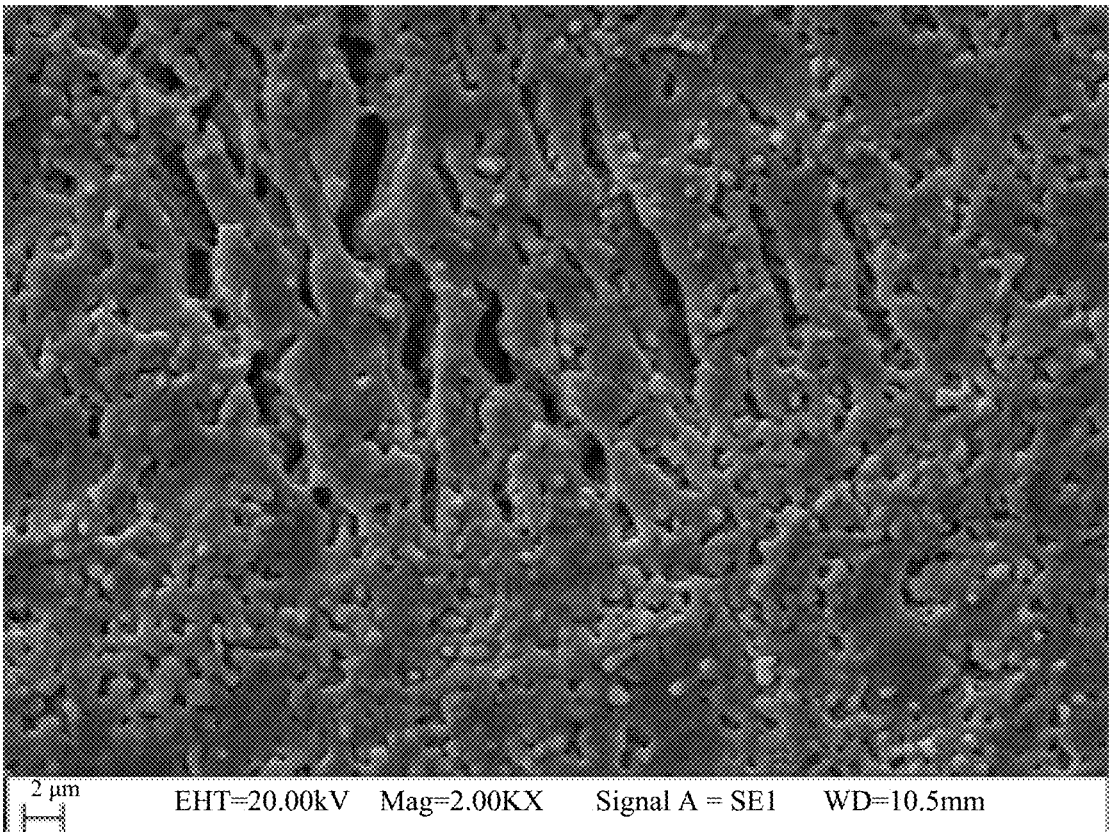

FIG. 8 is a scanning image of the cross section effect of an iron oxide skin on the surface of a hot-rolled sheet reduced in sections in one embodiment of the present invention; and FIG. 9 is a scanning image of the surface effect of an iron oxide skin on the surface of a hot-rolled sheet reduced in sections in one embodiment of the present invention.

PARTICULAR EMBODIMENT

In order to make the object, features and advantages of the present invention more apparent and easily understandable, particular embodiments of the present invention are described in detail in conjunction with the drawings. It is to be noted first that the present invention is not limited to the following particular embodiments, a person skilled in the art should understand the present invention from the spirit embodied by the following particular embodiments, and each technical term can be understood to the broadest extent based on the spirit of the present invention. Like reference signs in the drawings indicate like parts.

The present invention is a method for directly producing a pickling-free hot-plated thin strip product from molten steel, wherein a pickling free technique can be used to combine thin strip continuous casting production with hot plating production, so that a highly continuous production of a hot-plated product from molten steel with iron and steel is realized.

As shown in FIG. 7, the method for directly producing a pickling-free hot-plated sheet strip product from molten steel of the present invention comprises the following steps:

(1) smelting and refining to obtain a refined molten steel;

(2) thin strip continuous casting: after having been adjusted via a steel ladle 1 and a tundish 2, the liquid molten steel is solidified as a strip billet under the cooling action of a twin-roll strip casting machine 3 in a closed melting pool and protected using a mixed gas of an inert gas and a reducing gas in the billet casting process, the concentration of the reducing gas is 1-10%;

(3) hot rolling: as shown in the figure, the cast-rolled strip billet 5 enters the hot rolling machine 8 via the exit strip support plate 4, the support rollers 6 and the pinch rollers 7 so as to level the cast-rolled strip billet and change the sheet shape, or rolled to a suitable thickness so as to change the product specification; and when a roller having a large roughness is adopted, a mechanical disruption action may be further provided on the iron oxide skin on the surface of the cast strip billet, which is beneficial for the sequent reduction of the iron oxide skin, with the deformation rate being 1-30%, more preferably 5%, 10% or 20%. The procedure is an optional procedure, and the cast-rolled strip billet can also directly enter the reduction annealing stage without hot rolling;

(4) reduction annealing: in the reduction annealing furnace 9, the reduction is performed using a mixed gas of a reducing gas and an inert gas within a range of 450-600° C. for 1-5 minutes and within a range of 700-1000° C. for 1-3 minutes to remove the iron oxide skin produced in the previous procedure, wherein the concentration of the reducing gas in each section is the same or different, and the concentration of the reducing gas in the entire reduction furnace is 5-100%. Preferably, the concentration of said reducing gas is 5-30%. More preferably, the concentration of said reducing gas is 5%, 10% or 15%.

(5) Hot plating: Without mechanically brushing away elementary iron, the cast strip billet after having been cooled in the cooling section 11 in a protective atmosphere enters a transitory temperature holding section 12, then the zinc bath 13 to complete the hot plating with zinc and other alloy, is cooled in the after-plating cooling section 14 and then coiled by the coiling machine 15. The cooling in the above-mentioned cooling section 11 is as follows: when hot galvanization is performed, the cooling needs to be to 450-460° C.; when the hot plating with aluminium-zinc is performed, the cooling needs to be to 590-610° C.; and when the hot plating with aluminium-silicon is performed, the cooling needs to be to 680-670° C.

In the hot rolling step, a single stand is used and for avoiding oxidization occurring to the steel sheet surface, a blast device is added for discontinuously or continuously introducing an inert gas into the area to reduce the contact chance between the steel sheet and air as far as possible so as to reduce the oxidization on the surface of the steel sheet.

In the reduction annealing step, said inert gas is nitrogen or argon, and said reducing gas is hydrogen or carbon monoxide.

In addition, said mixed gas flows in a turbulence way in the reduction annealing furnace 9, and the content of water in the mixed gas is related to the content of hydrogen and temperature and are different according to different requirements for the mixed gas, wherein at 500° C., the hydrogen-water ratio ($PH_2/PH_2O$) is minimally 4.1, and at 1000° C., the hydrogen-water ratio ($PH_2/PH_2O$) is minimally 0.9. Preferably, said hydrogen-water ratio ($PH_2/PH_2O$) at 650° C. is higher than 100.

Before entering the reduction annealing furnace, the average thickness of the iron oxide skin on the surface of the strip billet is controlled at 1-5 μm (the average thickness of the iron oxide skin on the surface of the strip billet refers to the result obtained by dividing the sum of the iron oxide skin thicknesses measured at measurement points in representative positions, such as the head part, middle part, the tail part, the side part, etc., of the strip billet, with at least three points being taken in each position by the number of the total points). Thus, there will be no effect produced on the properties of a hot-plated product with reduced porous iron retained.

After the hot plating step, various operations such as alloying, oil coating, embossing, film coating or direct forming can be performed. In addition, in the hot plating step, the plating may be Zn, Zn—Al, Zn—Al—Mg, Zn—Al—Mg—Si, Al—Si or other alloy.

It can be seen from the above-mentioned particular embodiment that the method for directly producing a pickling-free hot-plated thin strip product from molten steel of the present invention is a process for directly changing molten steel into a hot-plated product using a twin-roll thin strip continuous casting technique combined with a pickling-free hot plating technique, mainly comprising: molten steel refining, thin strip billet continuous casting, hot rolling, reduction annealing, hot plating with zinc and other alloy, cooling and coiling; and as compared to traditional hot-galvanized product production routes, the present invention has the following advantages:

1. Short Product Manufacturing Flow

In the process, the hot-plated product is produced using molten steel directly, a plurality of traditional production lines of billet casting, hot rolling, pickling, cold rolling, continuous annealing and hot-galvanization are integrated as one line, so as to substantially shorten the processing route, substantially increase the production efficiency, and greatly reduce the equipment investment.

2. Economic, Energy Saving and Environmentally Friendly

Since a great amount of intermediate processing, transportation, storage and management costs are saved, and the production efficiency is high, the product cost is greatly reduced; no surface dephosphorization is required for the hot-rolled sheet, which also omits the original steps such as cooling after hot rolling, coiling and uncoiling, mechanically brushing away elementary iron, with the metal recovery being close to 100%, without any effect produced on the properties of the product; the energy consumption in the middle chain is saved, so that the energy consumption for the product is greatly reduced; and there is neither any polluting substance used in the production process, nor harmful waste gas and waste liquid discharged, which provides a prominent environmentally friendly advantage.

3. The principle why the reduction section using this method can greatly improve the reduction rate lies in: under conditions of 450-600° C., ferroferric oxide among the oxides can be directly reduced into metal iron, ferrous oxide will undergo a disproportionation reaction at about 570° C. to produce metal iron and ferroferric oxide, and the ferroferric oxide can be then reduced into iron, wherein although the rates of these reactions are not high, the reactions can be performed continuously; moreover, at a lower temperature, the newly reduced iron is porous iron, which will not be sintered on the surface of the oxides to form a dense reduced iron layer; therefore, the smooth transfer of the reducing gas and the product will not be blocked, and the reaction rates are mainly limited to the intrinsic rates of the chemical reactions or controlled by the nucleation growth rate of reduced iron. It should be noted that, since the temperature is lower, the reduction rate is slower, a very long time is required for completely reducing the oxides; therefore, many dispersed oxides are still remained in these loose and porous structures, that is to say, although the surface is wrapped by the reduced iron, there are still a great amount of dispersed oxides in the inner centre, requiring a long time for reduction. In the second stage, the strip steel is heated to 700-1000° C., and at a high temperature, the residual oxides will be completely reduced within a very short time; in addition, the loose and porous structures of iron formed in the low temperature reduction stage will not form dense reduced iron which prevents the diffusion of the reactant and the product within a short time. With the extension of the temperature holding time at a high temperature, sintering fusion will occur between reduced iron and reduced iron and reduced iron and the steel substrate, which is also helpful for improving the adhesive force of the reduction layer.

As compared to the existing reduction annealing processes, the process has the following characteristics:

1. The reduction efficiency is high, wherein the two-section temperature holding annealing, by using the advantages of reduction reactions within the two temperature ranges, achieves highly efficient reduction annealing, so that complete reducing the iron oxide skin is achieved within a short time.

2. The low temperature reduction does not block the transfer channel of materials, and the high temperature reduction can enable a further complete reduction, and also has a sintering effect on the produced reduced iron, so that the reduction product porous iron is not easy to fall off from the substrate, and thus will not contaminate the environment in the furnace or cause nodulation occurring to the furnace roller surface, etc.

Therefore, the present invention has a plurality of advantages such as a simple process, a low equipment investment, a low energy consumption, a high product yield, a high reduction efficiency, being environmentally friendly, etc.

The above-mentioned embodiment of the present invention is further described through particular application embodiments below so as to more clearly understand the characteristics and advantages of the method of the present invention.

Example 1

The process route implemented in this example is: cast strip solidification-hot rolling and levelling-reduction annealing-cooling-hot galvanization-cooling-finishing-coiling.

Refined molten steel is cooled and solidified by a strip casting machine 3 to obtain a thin strip billet 5, the thin strip billet enters a hot rolling unit 8 via an exit strip support plate 4, support rollers 6 and pinch rollers 7, is subjected to hot levelling with a deformation rate of 3%, and enters a reduction annealing furnace 9, wherein since the iron oxide skin at this time is thinner and the temperature in the furnace is higher, the iron oxide skin on the surface is very rapidly and completely reduced into elementary iron; and after cooled by blowing in the cooling section 11 in the furnace to a temperature for entering the zinc bath, the sheet strip billet is held at the temperature in a soaking section 12 for a period of time and enters the zinc bath 13 for hot plating, and finally the strip steel is cooled in an after-plating cooling section 14, finished and coiled.

Figure 1:
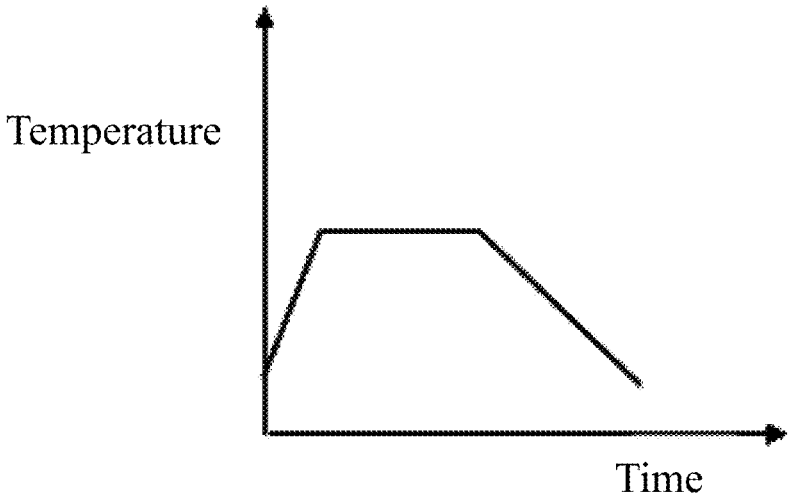
FIG. 1 is a schematic diagram of a process route of a traditional one-section reduction for directly producing a pickling-free hot-plated sheet strip product from molten steel.
Figure 2:
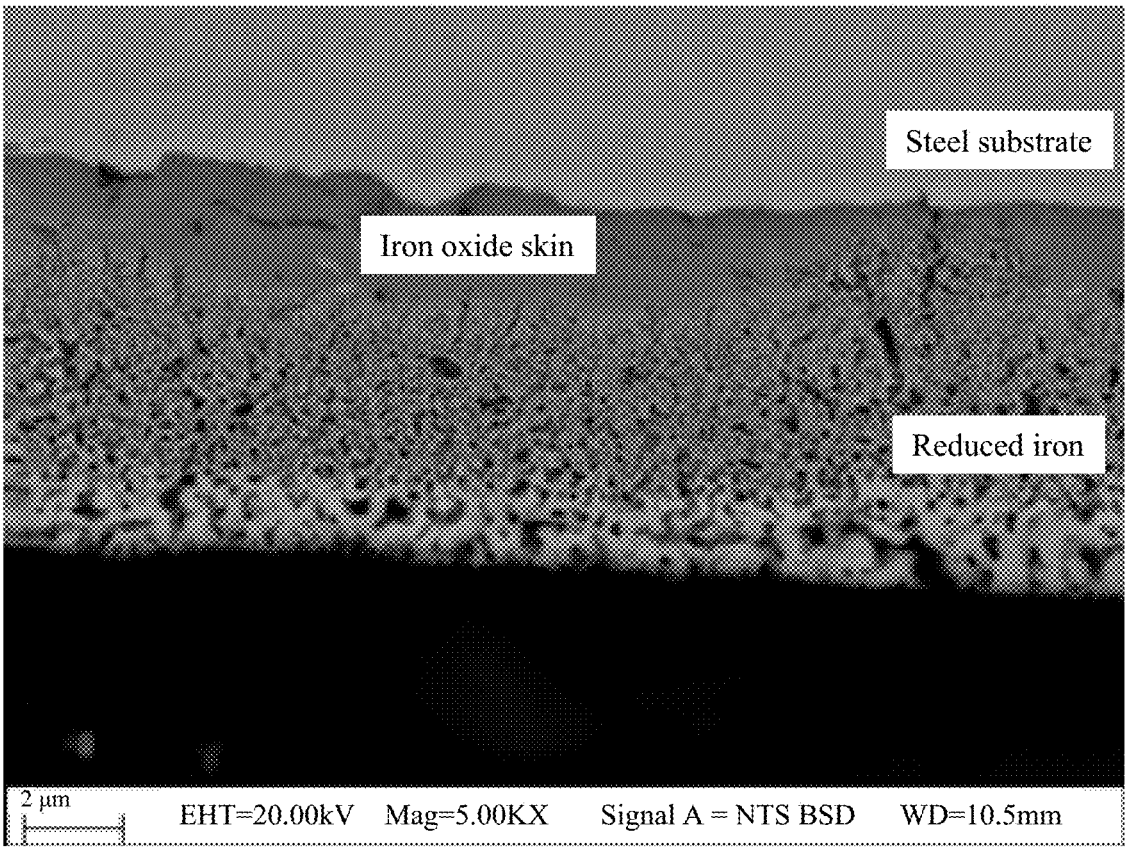
FIG. 2 is a scanning image of the cross section effect of an iron oxide skin on the surface of a hot-rolled sheet reduced at a low temperature in the traditional one-section reduction for directly producing a pickling-free hot-plated sheet strip product from molten steel (the reduction is not complete, the iron oxide close to the surface is reduced, while a great amount of oxides are remained at the under-layer)
Figure 3:
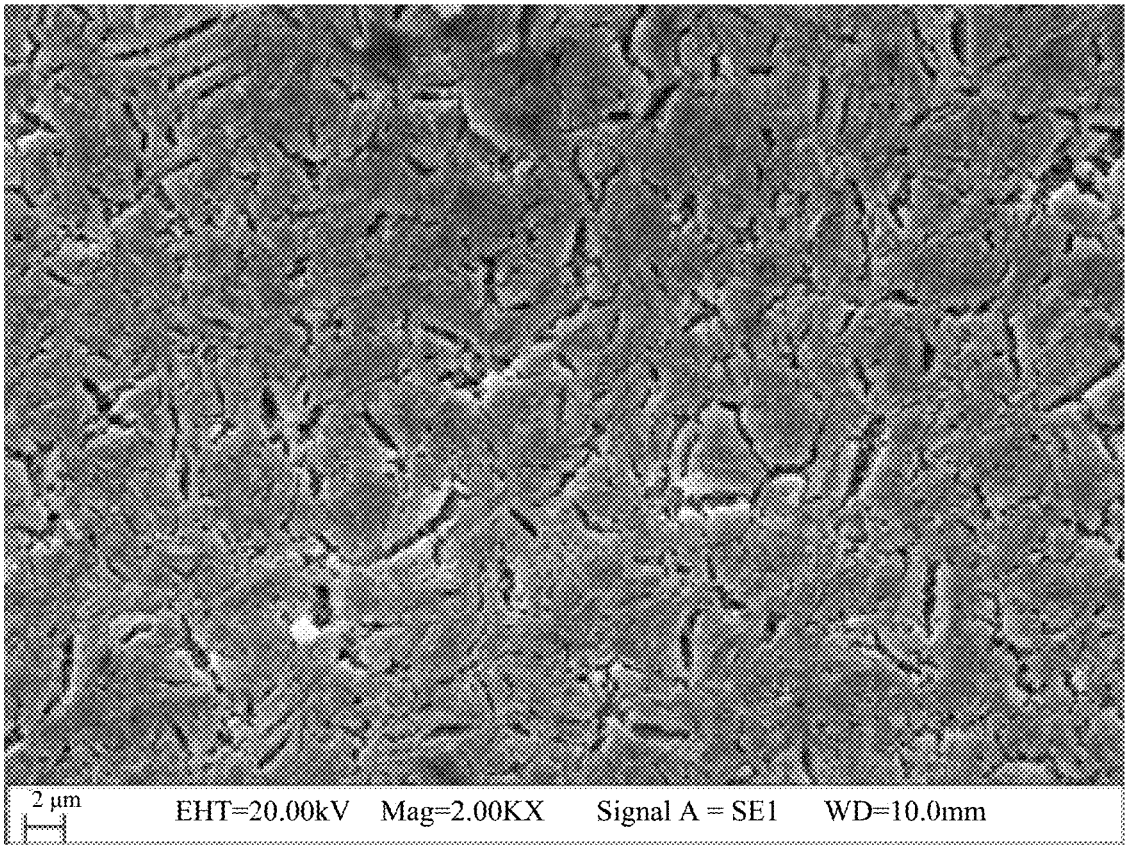
FIG. 3 is a scanning image of the surface effect of an iron oxide skin on the surface of the hot-rolled sheet reduced at a low temperature in the traditional one-section reduction for directly producing a pickling-free hot-plated sheet strip product from molten steel (there are large cracks present on the surface; moreover, the reduction efficiency is low, and there are still a great amount of oxides)
Figure 4:
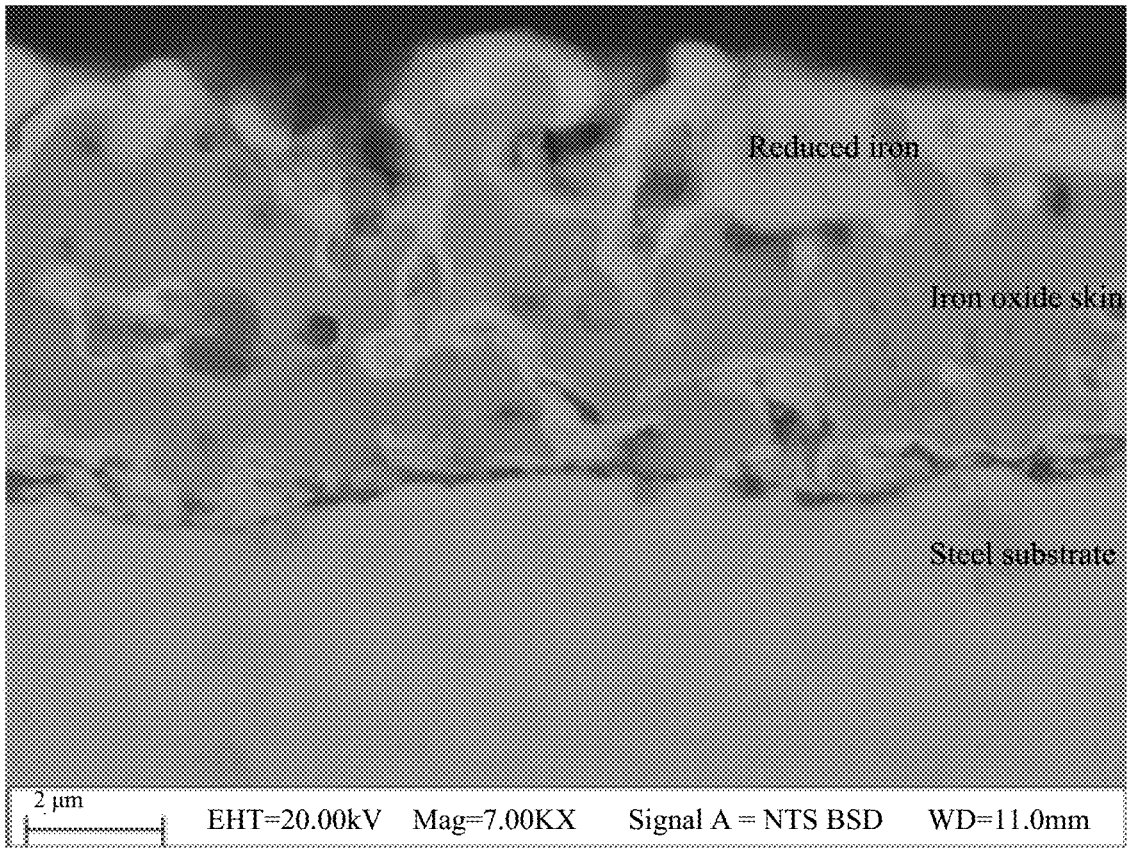
FIG. 4 is a scanning image of the cross section effect of an iron oxide skin on the surface of a hot-rolled sheet reduced at a high temperature in the traditional one-section reduction for directly producing a pickling-free hot-plated sheet strip product from molten steel (the reduction is not complete, and the periphery of oxides is reduced, while the centre is still oxides)
Figure 5:
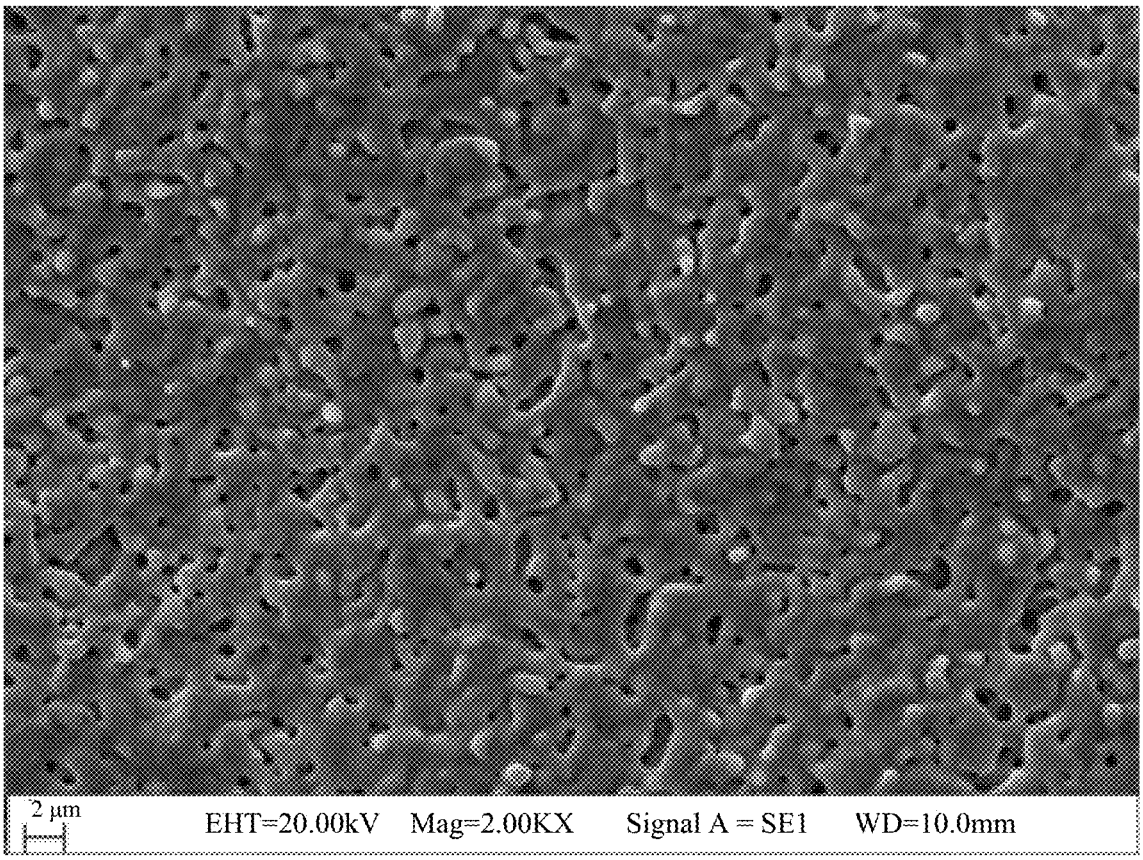
FIG. 5 is a scanning image of the surface effect of an iron oxide skin on the surface of a hot-rolled sheet reduced at a high temperature in the traditional one-section reduction for directly producing a pickling-free hot-plated sheet strip product from molten steel (the reduced iron is uniformly distributed on the surface, but has a dense structure and on the contrary blocks the transfer of the reducing gas, affecting the reduction of the oxides in the internal layer, and finally leading to a non-complete reduction)
Figure 6:
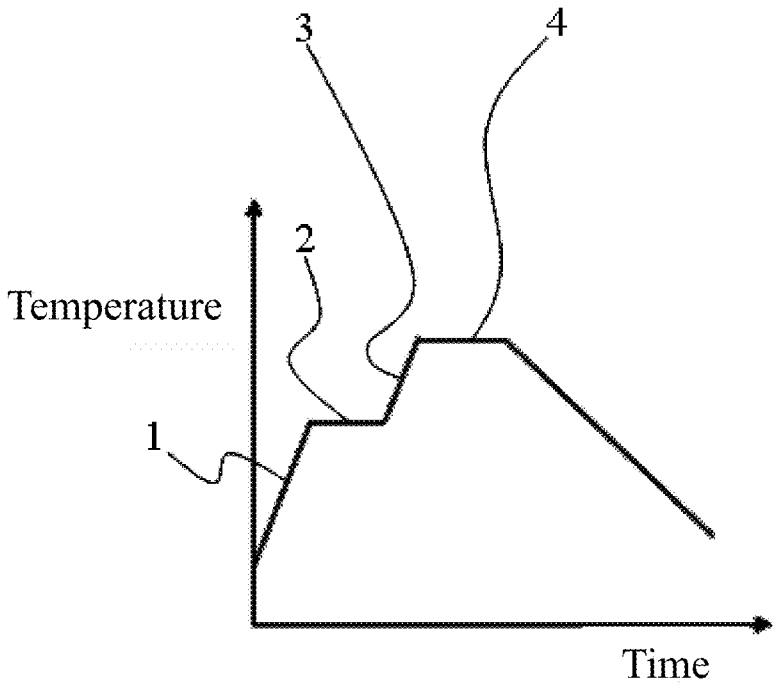
FIG. 6 is a schematic process route diagram of the two-section reduction method used in the reduction section process of the present invention.

This example is suitable for the production of common low-carbon low-alloy steel hot-plated with pure zinc, particularly suitable for the production of various construction steels with carbon structural steel as a representative. Particular process parameters are as shown in table 1: the holding temperature before plating is determined according to the type of the plating layer. The cross section morphology of the product after the reduction is as shown in FIG. 8, wherein the iron oxide skin is substantially reduced completely without obvious residual oxides, and the reduced iron is in a loose and porous form, the reduction effect being obviously superior to that in FIGS. 2 and 4; the surface morphology is as shown in FIG. 9, wherein the surface is porous reduced iron, with large crack holes present locally, and the features of the individual low temperature first section (FIG. 3) and the individual high temperature second section (FIG. 5) are summarized.

TABLE 1

| Process parameters of hot-galvanizing carbon steel | | | | | |
|---|---|---|---|---|---|
| Hot rolling | Reduction annealing | Cooling | Holding temperature | Temperature holding time | Hot-dip plating |
| the rolling speed being 5 m/s, and the deformation rate being 3% | holding the temperature at 550° C. for 90 s and at 800° C. for 90 s, the hydrogen concentration being 10% | a cooling speed of 5-30° C./s | 450-460° C. | 10 s | the dip plating time being 1-5 s |

Example 2

The process route implemented in this example is: cast strip solidification-hot rolling-reduction annealing-cooling-temperature holding-hot galvanization-cooling-finishing-coiling.

Refined molten steel is cooled and solidified by a strip casting machine 3 to obtain a thin strip billet 5, the thin strip enters a hot rolling unit 8 via an exit strip support plate 4, support rollers 6 and pinch rollers 7 and is hot-rolled to a suitable thickness with a deformation rate of 30%, with blast and ventilation devices added in the hot rolling working area for discontinuously or continuously introducing an inert gas into the area, the thin strip billet then enters a reduction annealing furnace 9 and is reduced, then cooled by blowing in a cooling section 11 in the furnace to a temperature for entering the zinc bath, the thin strip billet is held at the temperature in a soaking section 12 for a period of time and enters the zinc bath 13 for hot plating, and finally the strip steel is cooled in an after-plating cooling section 14, finished and coiled.

This example is suitable for hot-galvanized sheet strip billets having thinner specifications (not greater than 1 mm) or cases where thicker cast strip billets need to be thinned before use, and the reduction annealing procedure needs to be suitably enhanced because a thicker iron oxide skin may be produced in the hot rolling process; therefore, an inert gas protection measure is added. Particular process parameters are as shown in table 2:

TABLE 2

| Process parameters of hot-galvanized product | | | | | |
|---|---|---|---|---|---|
| Hot rolling | Reduction annealing | Cooling | Holding temperature | Temperature holding time | Hot-dip plating |
| the rolling speed being 1-6 m/s, the deformation rate being 30%, and the protective gas being nitrogen | holding the temperature at 500° C. for 120 s and at 800° C. for 180 s, the hydrogen concentration being 20% | a cooling speed of 5-30° C./s | 580-650° C. | 10 s | the dip plating time being 1-5 s |

Example 3

The process route implemented in this example is: cast strip solidification-reduction annealing-cooling-temperature holding-hot plating with zinc-aluminium-magnesium-cooling-finishing-coiling.

Refined molten steel is cooled and solidified by a strip casting machine 3 to obtain a cast strip billet 5, the strip billet directly enters a reduction annealing furnace 9 via an exit strip support plate 4, support rollers 6 and pinch rollers 7 and is reduced, then cooled by blowing in a cooling section 11 in the furnace to a temperature for entering the zinc bath, the sheet strip billet is held at the temperature in a soaking section 12 for a period of time and enters the zinc bath 13 for hot plating with zinc-aluminium-magnesium, and finally the strip steel is cooled in an after-plating cooling section 14, finished and coiled.

In this example, the reduction annealing procedure needs to be enhanced via measures such as suitably increasing the reduction temperature, prolonging the reduction time and improving the hydrogen concentration. Particular process parameters are as shown in table 3.

TABLE 3

| Process parameters of zinc-aluminium-magnesium hot-plated product | | | | |
|---|---|---|---|---|
| Reduction annealing | Cooling | Holding temperature | Temperature holding time | Hot-dip plating |
| holding the temperature at 580° C. for 60 s and at 850° C. for 60 s, the hydrogen concentration being 30% | a cooling speed of 5-30° C./s | 450-460° C. | 10 s | the dip plating time being 1-5 s, and the composition of the plating solution being: 1.6%Al—1.6Mg—Zn |

Example 4

The process route implemented in this example is: cast strip solidification-reduction annealing-cooling-temperature holding-hot plating with aluminium-zinc-cooling-finishing-coiling.

Refined molten steel is cooled and solidified by a strip casting machine 3 to obtain a cast strip billet 5, the strip billet directly enters a reduction annealing furnace 9 via an exit strip support plate 4, support rollers 6 and pinch rollers 7 and is reduced, then cooled by blowing in a cooling section 11 in the furnace to a temperature for entering the zinc bath, the sheet strip billet is held at the temperature in a soaking section 12 for a period of time and enters the zinc bath 13 for hot plating with aluminium-zinc, and finally the strip steel is cooled in an after-plating cooling section 14, finished and coiled.

In this example, the reduction annealing procedure needs to be enhanced via measures such as suitably increasing the reduction temperature, prolonging the reduction time and improving the hydrogen concentration. Particular process parameters are as shown in table 4:

TABLE 4

| Process parameters of aluminium-zinc hot-plated product | | | | |
|---|---|---|---|---|
| Reduction annealing | Cooling | Holding temperature | Temperature holding time | Hot-dip plating |
| holding the temperature at 600° C. for 90 s and at 900° C. for 120 s, the hydrogen concentration being 30% | a cooling speed of 5-30° C./s | 620° C. | 10 s | the dip plating time being 1-5 s, and the composition of the plating solution being: 55%Al—Zn |

Example 5

The process route implemented in this example is: cast strip solidification-reduction annealing-cooling-temperature holding-hot plating with aluminium-silicon-cooling-finishing-coiling.

Refined molten steel is cooled and solidified by a strip casting machine 3 to obtain a cast strip billet 5, the strip billet directly enters a reduction annealing furnace 9 via an exit strip support plate 4, support rollers 6 and pinch rollers 7 and is reduced, then cooled by blowing in a cooling section 11 in the furnace to a temperature for entering the zinc bath, the sheet strip billet is held at the temperature in a soaking section 12 for a period of time and enters the zinc bath 13 for hot plating with aluminium-silicon, and finally the strip steel is cooled in an after-plating cooling section 14, finished and coiled.

In this example, the reduction annealing procedure needs to be enhanced via measures such as suitably increasing the reduction temperature, prolonging the reduction time and improving the hydrogen concentration. Particular process parameters are as shown in table 5:

TABLE 5

| Process parameters of aluminium-silicon hot-plated product | | | | |
|---|---|---|---|---|
| Reduction annealing | Cooling | Holding temperature | Temperature holding time | Hot-dip plating |
| holding the temperature at 550° C. for 300 s and at 800° C. for 180 s, the hydrogen concentration being 20% | a cooling speed of 5-30° C./s | 680° C. | 10 s | the dip plating time being 1-5 s, and the composition of the plating solution being: 11%Si—Al |

Upon practical verification, the above five examples can all achieve the expected target of the present invention, and the resulting hot-plated products can all reach the production expectation and customer requirements.

It should be understood that after reading the above-mentioned contents taught by the present invention, a person skilled in the art could make various changes or modifications to the present invention, and these equivalent forms likewise fall within the scope defined by the scope of the appended claims of the present application.

The invention claimed is:

1. A method for producing a pickling-free hot-plated sheet strip product directly from molten steel, characterized by comprising the following steps:

smelting and refining to obtain a refined molten steel;

thin strip continuous casting: after adjusting via a steel ladle and a tundish, the refined molten steel is solidified as a strip billet under the cooling action of a twin-roll strip casting machine in a closed melting pool, and the billet casting process is performed under protection of a mixed gas of an inert gas and a reducing gas;

reduction annealing: the strip billet is brought into a reduction annealing furnace and reduced by a mixed gas of an inert gas and a reducing gas to remove an iron oxide skin produced in the previous procedure; and hot plating: after cooling the strip billet obtained from reduction annealing in a protective atmosphere to a temperature for hot plating, the strip billet is brought into a zinc bath and hot-galvanized or hot-plated with other alloy, and then cooled and coiled;

wherein there are no coiling and uncoiling step before hot plating.

2. The method for producing a pickling-free hot-plated thin strip product directly from molten steel according to claim 1, characterized by further comprising a hot rolling step after the thin strip continuous casting: the strip billet is levelled at a high temperature so as to improve the sheet shape and rolled to a suitable thickness so as to change product specification of the strip, or provide a mechanical disruption action on the iron oxide skin on the surface of the strip billet, with the deformation rate being 1-30%.

3. The method for producing a pickling-free hot-plated sheet strip product directly from molten steel according to claim 2, characterized in that said deformation rate is 5%, 10% or 20%.

4. The method for producing a pickling-free hot-plated sheet strip product directly from molten steel according to claim 2, characterized in that in the hot rolling step, a single stand is used and a blast device is provided for discontinuously or continuously introducing an inert gas into the hot rolling area to reduce the contact chance between the steel sheet and air so as to reduce the oxidization on the surface of the steel sheet.

5. The method for producing a pickling-free hot-plated sheet strip product directly from molten steel according to claim 2, characterized in that said reduction furnace comprises a first heating and temperature holding section and a second heating and temperature holding section, and the hot-rolled sheet undergoes sectional heating and temperature holding within two ranges, which are 450-600° C. and 700-1000° C., by the two heating and temperature holding sections respectively so as to reduce the iron oxide skin on the surface of the hot-rolled sheet respectively, wherein the reduction is performed within a range of 450-600° C. for 1-5 minutes and within a range of 700-1000° C. for 1-3 minutes; and the reducing gas is always maintained from the first heating section to an exit of a cooling section in said reduction furnace, wherein the concentration of the reducing gas in each section is the same or different, and the concentration of the reducing gas in the entire reduction furnace is 5 to less than 100%.

6. The method for producing a pickling-free hot-plated thin strip product directly from molten steel according to claim 1, wherein the concentration of the reducing gas in the mixed gas using in the thin strip continuous casting is 1-10%.

7. The method for producing a pickling-free hot-plated sheet strip product directly from molten steel according to claim 1, characterized in that said reduction furnace comprises a first heating and temperature holding section and a second heating and temperature holding section, and the hot-rolled sheet undergoes sectional heating and temperature holding within two ranges which are 450-600° C. and 700-1000° C., by the two heating and temperature holding sections respectively so as to reduce the iron oxide skin on the surface of the hot-rolled sheet respectively, wherein the reduction is performed within a range of 450-600° C. for 1-5 minutes and within a range of 700-1000° C. for 1-3 minutes; and the reducing gas is always maintained from the first heating section to an exit of a cooling section in said reduction furnace, wherein the concentration of the reducing gas in each section is the same or different, and the concentration of the reducing gas in the entire reduction furnace is 5 to less than 100%.

8. The method for producing a pickling-free hot-plated sheet strip product directly from molten steel according to claim 7, characterized in that in the reduction annealing step the concentration of said reducing gas is 5-30%.

9. The method for producing a pickling-free hot-plated sheet strip product directly from molten steel according to claim 7, characterized in that in the reduction annealing step the concentration of said reducing gas is 5%, 10% or 15%.

10. The method for producing a pickling-free hot-plated sheet strip product directly from molten steel according to claim 9, characterized in that in the reduction annealing step, said mixed gas flows in a turbulence way in the furnace, and water and hydrogen content in the mixed gas are related to temperature, wherein at the same temperature, the lower the water content or the greater the hydrogen-water ratio, the higher the iron oxide reduction efficiency; and when the water content is too high or when the hydrogen-water ratio is lower than a certain value, the reaction cannot occur, and at different temperatures, the minimum value of hydrogen-water ratio varies slightly, the minimum value of the hydrogen-water ratio being slightly smaller at a higher temperature.

11. The method for producing a pickling-free hot-plated sheet strip product directly from molten steel according to claim 10, characterized in that in the reduction annealing step at 500° C., the hydrogen-water ratio is minimally 4.1; and at 1000° C., the hydrogen-water ratio is minimally 0.9.

12. The method for producing a pickling-free hot-plated sheet strip product directly from molten steel according to claim 1, characterized in that in the thin strip continuous casting and in the reduction annealing step, said inert gas is nitrogen or argon, and said reducing gas is hydrogen or carbon monoxide.

13. The method for producing a pickling-free hot-plated sheet strip product directly from molten steel according to claim 1, characterized in that before entering the reduction annealing furnace, the iron oxide skin on the surface of the strip billet is controlled at an average thickness of 1-5 μm.

14. The method for producing a pickling-free hot-plated sheet strip product directly from molten steel according to claim 1, characterized in that in the hot plating step, when the hot galvanization is performed, the strip billet is cooled to 450-460° C.; when the hot plating with aluminium-zinc is performed, the strip billet is cooled to 590-610° C.; and when the hot plating with aluminium-silicon is performed, the strip billet is cooled to 680-670° C.

15. The method for producing a pickling-free hot-plated sheet strip product directly from molten steel according to claim 1, characterized in that in the hot plating step, the strip billet is hot-plated with Zn—Al, Zn—Al—Mg, Zn—Al—Mg—Si, or Al—Si alloy.

16. The method for producing a pickling-free hot-plated sheet strip product directly from molten steel according to claim 1, characterized in that after the hot plating step, alloying, oil coating, embossing, film coating or a direct forming procedure can be performed.

17. A method for producing a pickling-free hot-plated sheet strip product directly from molten steel, comprising the following steps:

smelting and refining to obtain a refined molten steel;

thin strip continuous casting: after adjusting via a steel ladle and a tundish, the refined molten steel is solidified as a strip billet under the cooling action of a twin-roll strip casting machine in a closed melting pool, and the billet casting process is performed under protection of a mixed gas of an inert gas and a reducing gas;

reduction annealing: the strip billet is brought into a reduction annealing furnace and reduced by a mixed gas of an inert gas and a reducing gas to remove an iron oxide skin produced in the previous procedure; and hot plating: after cooling in a protective atmosphere, the strip billet is brought into a zinc bath and hot-galvanized or hot-plated with other alloy, and then cooled and coiled;

wherein said reduction furnace comprises a first heating and temperature holding section and a second heating and temperature holding section, and the hot-rolled sheet undergoes sectional heating and temperature holding within two ranges, which are 450-600° C. and 700-1000° C., by the two heating and temperature holding sections respectively so as to reduce the iron oxide skin on the surface of the hot-rolled sheet respectively, wherein the reduction is performed within a range of 450-600° C. for 1-5 minutes and within a range of 700-1000° C. for 1-3 minutes; and the reducing gas is always maintained from the first heating section to an exit of a cooling section in said reduction furnace, wherein the concentration of the reducing gas in each section is the same or different, and the concentration of the reducing gas in the entire reduction furnace is 5 to less than 100%.

18. The method for producing a pickling-free hot-plated thin strip product directly from molten steel according to claim 17, further comprising a hot rolling step after the thin strip continuous casting: the strip billet is levelled at a high temperature so as to improve the sheet shape and rolled to a suitable thickness so as to change product specification of the strip, or provide a mechanical disruption action on the iron oxide skin on the surface of the strip billet, with the deformation rate being 1-30%.

19. The method for producing a pickling-free hot-plated sheet strip product directly from molten steel according to claim 18, wherein in the hot rolling step, a single stand is used and a blast device is provided for discontinuously or continuously introducing an inert gas into the hot rolling area to reduce the contact chance between the steel sheet and air so as to reduce the oxidization on the surface of the steel sheet.

20. The method for producing a pickling-free hot-plated thin strip product directly from molten steel according to claim 17, wherein the concentration of the reducing gas in the mixed gas using in the thin strip continuous casting is 1-10%.

21. The method for producing a pickling-free hot-plated sheet strip product directly from molten steel according to claim 17, wherein in the reduction annealing step the concentration of said reducing gas is 5-30%.

22. The method for producing a pickling-free hot-plated sheet strip product directly from molten steel according to claim 17, wherein in the thin strip continuous casting and in the reduction annealing step, said inert gas is nitrogen or argon, and said reducing gas is hydrogen or carbon monoxide.

23. The method for producing a pickling-free hot-plated sheet strip product directly from molten steel according to claim 17, wherein in the reduction annealing step, said mixed gas flows in a turbulence way in the furnace, and water and hydrogen content in the mixed gas are related to temperature, wherein at the same temperature, the lower the water content or the greater the hydrogen-water ratio, the higher the iron oxide reduction efficiency; and when the water content is too high or when the hydrogen-water ratio is lower than a certain value, the reaction cannot occur, and at different temperatures, the minimum value of hydrogen-water ratio varies slightly, the minimum value of the hydrogen-water ratio being slightly smaller at a higher temperature.

24. The method for producing a pickling-free hot-plated sheet strip product directly from molten steel according to claim 23, wherein in the reduction annealing step at 500° C., the hydrogen-water ratio is minimally 4.1; and at 1000° C., the hydrogen-water ratio is minimally 0.9.

25. The method for producing a pickling-free hot-plated sheet strip product directly from molten steel according to claim 17, wherein in the hot plating step, when the hot galvanization is performed, the strip billet is cooled to 450-460° C.; when the hot plating with aluminium-zinc is performed, the strip billet is cooled to 590-610° C.; and when the hot plating with aluminium-silicon is performed, the strip billet is cooled to 680-670° C.

26. The method for producing a pickling-free hot-plated sheet strip product directly from molten steel according to claim 17, wherein in the hot plating step, the strip billet is hot-plated with Zn—Al, Zn—Al—Mg, Zn—Al—Mg—Si, or Al—Si alloy.

* * * * *